United States Patent [19]

Kar et al.

[11] Patent Number: 4,683,781

[45] Date of Patent: Aug. 4, 1987

[54] CAST STEEL ROCK BIT CUTTER CONES HAVING METALLURGICALLY BONDED CUTTER INSERTS, AND PROCESS FOR MAKING THE SAME

[75] Inventors: Nareshchandra J. Kar, Westminster; William J. Salesky, Huntington Beach; Steven J. Guzowski, Fountain Valley, all of Calif.

[73] Assignee: Smith International, Inc., Newport Beach, Calif.

[21] Appl. No.: 897,228

[22] Filed: Aug. 15, 1986

Related U.S. Application Data

[62] Division of Ser. No. 655,140, Sep. 27, 1984, abandoned.

[51] Int. Cl.[4] ..... B22D 19/06

[52] U.S. Cl. ..... 76/108 A; 76/DIG. 11

[58] Field of Search ..... 76/108 R, 108 A, DIG. 2, 76/DIG. 11, DIG. 3, DIG. 6, 101 A; 164/91, 97

[56] References Cited

U.S. PATENT DOCUMENTS

| | | | |
|---|---|---|---|
| 1,043,831 | 11/1912 | Heinkel et al. | 76/DIG. 3 |
| 1,090,533 | 3/1914 | Heinkel et al. | 76/101 A |
| 1,092,925 | 4/1914 | Machlet | 76/DIG. 2 |
| 1,926,770 | 9/1933 | Harris et al. . | |
| 2,134,776 | 12/1939 | Cottrell | 76/DIG. 11 |
| 3,003,370 | 10/1961 | Coulter, Jr. | 76/DIG. 2 |
| 3,294,186 | 12/1966 | Buell . | |
| 3,666,029 | 5/1972 | Dixon | 76/108 A |
| 3,970,158 | 7/1976 | Black et al. . | |
| 4,389,074 | 6/1983 | Greenfield . | |
| 4,423,646 | 1/1984 | Bernhardt | 76/108 R |
| 4,593,776 | 7/1986 | Salesky et al. | 76/108 A |

FOREIGN PATENT DOCUMENTS

| | | | |
|---|---|---|---|
| 672257 | 2/1939 | Fed. Rep. of Germany | 76/DIG. 6 |

*Primary Examiner*—Roscoe V. Parker

*Attorney, Agent, or Firm*—Robert G. Upton

[57] ABSTRACT

Tools, and particularly rock bit cutter cones, having "hard" cermet cutter inserts enveloped in an intermediate layer or coating of a suitable high melting metal, and embedded in a cast steel matrix, are disclosed. The cermet inserts, which usually comprise tungsten carbide in a cobalt phase (WC-Co), are coated with a layer of a metal or metal alloy, preferably nickel, which does not substantially melt during the subsequent step of casting the steel matrix of the tool. An additional layer of copper is advantageously employed on the cermet insert beneath the layer of the high melting metal, such as nickel. The coated inserts are held in appropriate position in a suitable mold, and the steel matrix of the tool is poured from molten metal. The coatings on the cermet inserts prevent thermal shock to the inserts, prevent deterioration of the cermet due to diffusion of carbon into the adjacent steel, and metallurgically bond the inserts to the embedding steel matrix.

16 Claims, 5 Drawing Figures

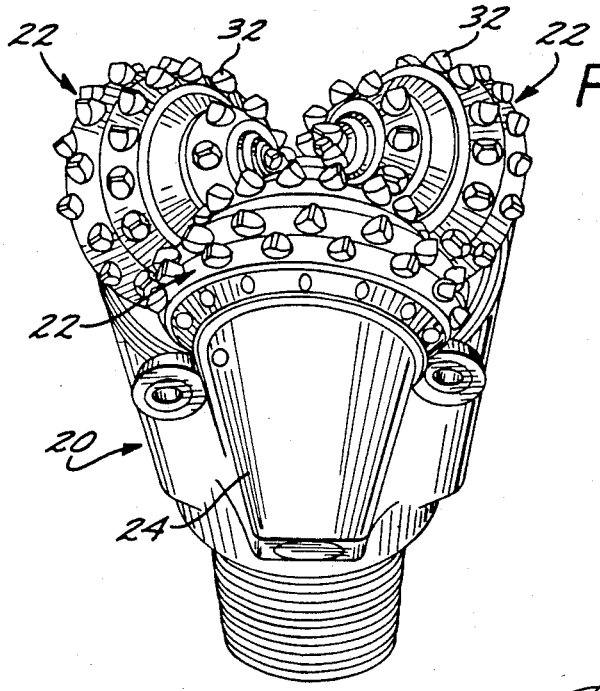
FIG. 1
FIG. 2
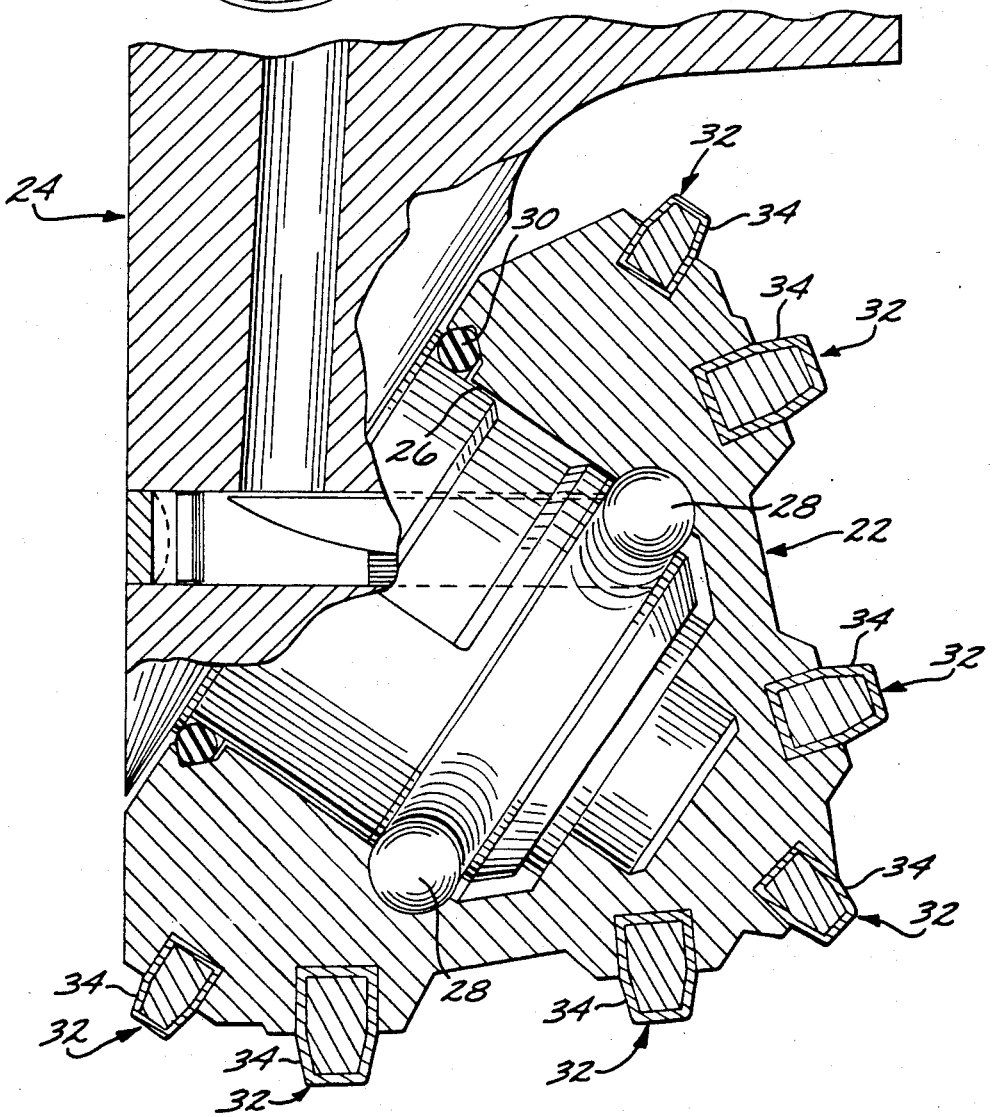

CAST STEEL ROCK BIT CUTTER CONES HAVING METALLURGICALLY BONDED CUTTER INSERTS, AND PROCESS FOR MAKING THE SAME

CROSS REFERENCE TO RELATED APPLICATIONS

This is a division of application Ser. No. 655,140, filed Sept. 27, 1984, and now abandoned.

BACKGROUND OF THE INVENTION

1. Field of the Invention

The present invention is directed to innovations in the manufacture of rock bits. More particularly, the present invention is directed to cast steel rock bit cutter cones into which hard cermet cutting inserts are incorporated during the casting process.

2. Brief Description of the Prior Art

Rock bit cutter cones having cemented carbide-type cutter inserts are, generally speaking, used for drilling in subterranean formations under conditions where other drilling cones, such as "milled tooth" cones, would provide relatively low rates of penetration and shorter bit runs. The hard cutter inserts incorporated into rock bits typically comprise cermets, such as tungsten carbide (or other hard metal carbide) in a metal binder phase. The most frequently used cutter inserts for rock bits comprise tungsten carbide in a cobalt binder (WC-Co).

In accordance with typical prior art practice for the preparation of cutter cones having cermet inserts, the steel cutter cones are made first by forging. Thereafter, holes are drilled into the steel cutter cone for accepting the cermet cutter inserts. The cutter inserts usually have a cylindrical base and are usually mounted into the holes with an interference fit. This method of mounting the cutter inserts to the cone is not entirely satisfactory, however, because it is labor intensive. Moreover, the inserts are often dislodged and lost from the cone due to excessive forces, repetitive loads, and shocks which unavoidably occur during subterranean drilling.

With regard to the foregoing, it should be recognized by those skilled in the art that retention of the inserts in the cone is highly dependent on the yield strength of the cone materials. However, in conventional cones, it is not possible or practical to increase the retention beyond a certain upper limit because increasing yield strength usually results in lowered fracture toughness potentially leading to cone cracking in service. Therefore, the acceptable upper limit of the yield strength of the cone is limited by the fracture toughness of such material and therefore rock bit insert retention through interference techniques is consequently limited.

In light of the foregoing and in an effort to improve the attachment of the cutter inserts to the cutter cones, the prior art has devised several techniques. For example, U.S. Pat. No. 4,389,074 describes brazing tungsten carbide cobalt inserts into a mining tool with a brazing alloy. U.S. Pat. No. 3,294,186 describes mounting of tungsten carbide cobalt inserts into rock bits using a layer of a brazing alloy, a nickel shim, and yet another layer of a brazing alloy. The procedure described in these two patents, however, is very labor intensive, because the brazing is performed in connection with each insert after the cutter cone, having the appropriate apertures for the inserts, has already been formed by conventional techniques.

Another approach taken by the prior art to improve the mounting of cutter inserts to the cutter cones, is to provide a widened, reverse taper base for the cutter inserts. Such inserts are mounted into the cutter cones by embedding the insert in a suitable metal powder, and thereafter forming the cutter cone through powder metallurgy processes.

A significantly improved rock bit cutter cone, having strongly bonded cutter inserts, is described in U.S. patent application Ser. No. 544,923, filed on Oct. 24, 1983 which is assigned to the same assignee as the present application and is now abandoned. The cutter cone of the invention described in the above-noted application has a steel core covered by a hard cladding formed by a suitable powder metallurgy process. Hard cermet cutter inserts are mounted into holes or openings provided in the steel core. The inserts are metallurgically bonded to the core and cladding during the hot isostatic pressing or like process in which the cladding is consolidated.

Still other techniques for affixing tungsten carbide inserts to drill bodies, tools, and the like are described in U.S. Pat. Nos. 1,926,770 and 3,970,158.

A problem encountered in the prior art in connection with cermet cutter inserts, and particularly tungsten carbide cobalt (WC-Co) cutter inserts relates to the formation, under certain conditions, of undesirable metallurgical phases, such as a brittle "eta" phase, in the WC-Co cutter inserts. More specifically, when the cermet insert surrounded by steel, such as a WC-Co insert mounted into a steel rock bit cutter cone, is heated to high temperature, the above-noted "eta" phase is formed in the insert, and the toughness and durability of the insert deteriorates significantly.

As is well understood by those skilled in the metallurgical sciences, the "eta" phase is formed in the tungsten carbide cobalt insert by Fick's Law diffusion of carbon from the insert into the surrounding steel cone matrix. Essentially, the relatively high carbon content of the tungsten carbide cobalt insert, and the high affinity of the adjacent steel for carbon, provide the driving force for the above-noted diffusion, and cause the attendant deterioration of the insert.

Except for the above-mentioned application for U.S. patent Ser. No. 544,923, the prior art was, by-and-large, unable to prevent the formation of undesirable "eta" phase in WC-Co cutter inserts under the above-noted conditions. The foregoing provides perhaps the principal reason why, up to the present invention, the majority of rock bit cutter cones which had WC-Co cutter inserts, had the inserts merely interference fitted in the apertures previously formed in the steel cone of the rock bit.

Moreover, even though it has been considered desirable to have a thermal barrier on the insert for minimizing or eliminating thermally generated fracture associated with casting, as well as retarding or eliminating "eta" phase formation, the prior art was limited in this regard to titanium nitride and titanium carbide coated inserts. The titanium nitride and titanium carbide coated inserts, however, are not bonded to the resulting steel matrix by metallurgical bonds. Therefore, often they are held loosely, and under harsh conditions are likely to rotate, to be lost, or to initiate cracking in the steel matrix.

SUMMARY OF THE INVENTION

It is an object of the present invention to provide a tool having hard metal carbide cutter inserts in a steel matrix, wherein the cutter inserts are affixed in the matrix by metallurgical bonds.

It is another object of the present invention to provide rock bit cutter cones with hard metal carbide cutter inserts embedded in the steel cutter cones and forming metallurgical bonds with the adjacent matrix.

It is still another object of the present invention to provide rock bit cutter cones with solidly embedded tungsten carbide cobalt inserts, wherein undesirable "eta" phase is substantially eliminated from the inserts.

It is yet another object of the present invention to provide a relatively economical process for fabricating cast steel tools having solidly embedded hard metal carbide cutter inserts.

It is a further object of the present invention to provide a relatively economical process for fabricating cast steel rock bit cutter cones having solidly embedded tungsten carbide cobalt cutter inserts, wherein undesirable deterioration of the inserts due to "eta" phase formation is substantially eliminated.

It is still a further object of the present invention to provide a process for fabricating such bit cutter cones of high structural integrity, wherein thermal cracking is substantially eliminated in the process of casting the cones and embedding metal carbide cutter inserts in the cone.

The foregoing and other objects and advantages are attained by a steel tool, such as a rock bit cutter cone, wherein one or several hard metal carbide cutter inserts have a coating of a suitable metal disposed between the inserts and the cast steel matrix of the tool.

The inserts can be made of tungsten carbide in a cobalt binder, tungsten carbide in iron binder, tungsten carbide in iron-nickel binder, tungsten carbide in iron-nickel-cobalt binder, non-stochiometric tungsten molybdenum carbide in cobalt binder, non-stochiometric tungsten molybdenum carbide in iron-nickel binder, or non-stochiometric tungsten molybdenum carbide in iron-nickel-cobalt binder. Most frequently the inserts are made of tungsten carbide in a cobalt binder phase.

The inserts are coated or plated with a metal layer or layers which do not significantly melt at the temperature at which the steel matrix of the tool is cast. Preferred metal of the coating is nickel, but other suitable metals include nickel alloys, titanium, titanium alloys, irridium, irridium alloys, tungsten, tungsten alloys, rhodium, rhodium alloys, osmium, osmium alloys, niobium, niobium alloys, molybdenum, molybdenum alloys, chromium, and chromium alloys. The coating is preferably deposited on the inserts by electroplating. An additional coating of copper or copper alloys is preferably also deposited on the inserts beneath the coating of the above-noted high melting metals.

During fabrication of the steel tool, the coated inserts are held in a suitable mold and the steel body of the tool is then poured in accordance with substantially standard casting procedures. The coating or plating of the inserts accomplishes the following. Thermal shocks in the inserts due to process cycling are minimized or eliminated. Diffusion of carbon from the inserts into the surrounding steel matrix is eliminated or at least minimized, and the inserts are metallurgically bonded to the steel matrix in the resulting tool.

A combination of a coating of copper and a coating of nickel on tungsten carbide cobalt inserts is particularly advantageous for the fabrication of rock bit cutter cones having such cermet cutter inserts, because undesirable "eta" phase formation through carbon diffusion is effectively eliminated in the inserts by the copper coating, and the nickel coating binds the inserts to the steel core of the tool through metallurgical bonds.

The features of the present invention can be best understood, together with further objects and advantages, by reference to the following description taken together with the accompanying drawings.

BRIEF DESCRIPTION OF THE DRAWINGS

FIG. 1 is a perspective view of a rock bit incorporating the cutter cone of the present invention;

FIG. 2 is a partial cross-sectional view of a journal leg of a rock bit with the cutter cone of the present invention mounted thereon;

DESCRIPTION OF THE PREFERRED EMBODIMENTS

Figure 3:
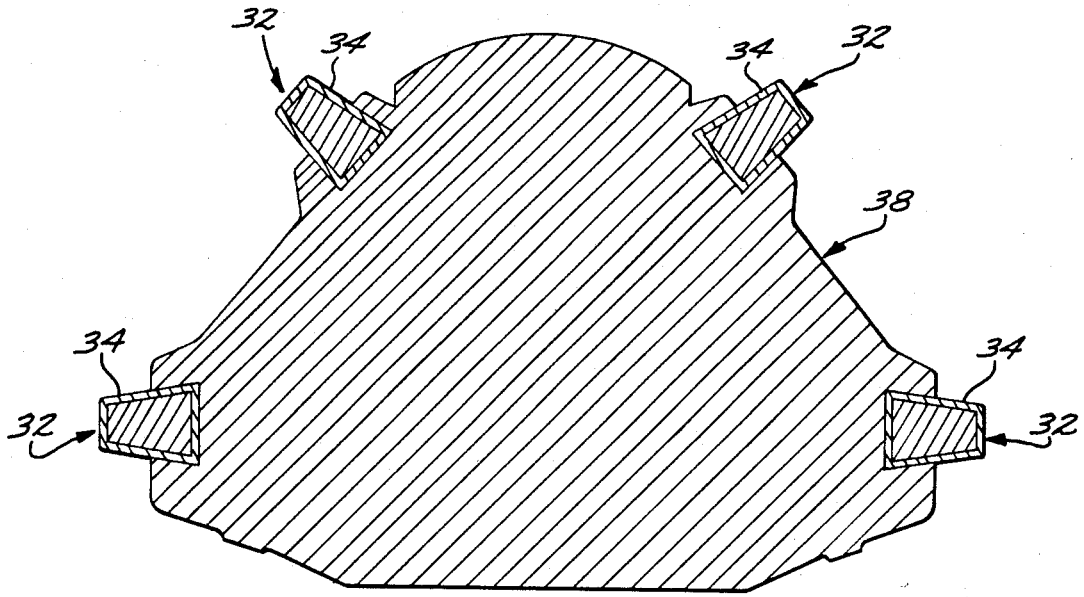
FIG. 3 is a schematic cross-sectional view of an intermediate in the fabrication of the cutter cone of the present intermediate having a solid core.

The following specification taken in conjunction with the drawings set forth the preferred embodiments of the present invention. The embodiments of the invention disclosed herein are the best modes contemplated by the inventors for carrying out their invention in a commercial environment, although it should be understood that various modifications can be accomplished within the scope of the present invention.

It is noted at the outset of the present description that the present invention broadly encompasses novel construction of cast steel tools which incorporate "hard" metal carbide cutter inserts. Therefore, various kinds of tools to be used, for example, in material cutting and shaping operations, may be constructed in accordance with the present invention. The scope of the present invention is not limited by the precise nature of the tool.

A principal application of the present invention is, however, for the construction of rock bit cutter cones which incorporate a plurality of hard metal carbide cutter inserts. Therefore, the invention is described principally in connection with such rock bit cutter cones.

Referring now to FIG. 1 of the appended drawings, a rock bit 20 of the type which incorporates three of the cutter cones 22 of the present invention, is shown. The partial cross-sectional view of FIG. 2 illustrates one journal leg 24 of the rock bit 20, to which the cutter cone 22 of the present invention is mounted. Because the overall mechanical configuration of the rock bit 20 is conventional in most respects, it is disclosed here only briefly, to the extent necessary to explain and illustrate the present invention. For a detailed description of the conventional features of rock bits, the specifications of U.S. Pat. No. 4,358,384 is incorporated herein by reference.

Thus, the rock bit 20 includes three journal legs 24, and a cutter cone 22 mounted on each journal leg 24. The cutter cone 22 and the journal leg 24 are provided with suitable bearings 26 so that the cutter cone 22 can rotate on the journal leg 24. A plurality of balls 28 secure the cutter cone 22 to the journal leg 24. The bearings 26 are usually lubricated by an internal supply (not shown) of lubricant (not shown), and the bearings 26 are sealed with an elastic seal 30 against entry of extraneous material, such as drilling mud (not shown).

A plurality of "hard" metal carbide cutter inserts 32 are mounted to each cutter cone 22 of the rock bit 20, as is shown on FIGS. 1, 2, and 3. More specifically, the cutter inserts 32 consist of cermet materials, that is hard metal carbides incorporated in a suitable metal binder phase. The cermet cutter inserts 32 are harder than the metal body of the cutter cone 22. The hard cutter inserts 32 provide the cutting or drilling action in the subterranean formation (not shown), as the entire rock bit 20 is rotated by a power source, such as a rotary table (not shown) or down hole drilling motor (not shown), about the nominally vertical axis of the rock bit 20.

In accordance with the present invention, the cutter inserts 32 are incorporated into the cutter cone 22 by a casting technique. To this end, the cutter inserts 32 are coated with a layer or coating 34 of a metal or metal alloy which does not significantly melt at the temperature at which the steel cutter cone 22 is cast.

The most frequently used cutter inserts 32 consist substantially of tungsten carbide in a cobalt binder (WC-Co). Other cermets which are sufficiently hard and suitable for use as cutter inserts in connection with the present invention include tungsten carbide in iron binder, tungsten carbide in iron-nickel binder, tungsten carbide in iron-nickel-cobalt binder, non-stochiometric tungsten molybdenum carbide in cobalt binder, non-stochiometric tungsten molybdenum carbide in iron-nickel binder, and non-stochiometric tungsten molybdenum carbide in iron nickel cobalt binder.

Figure 4:
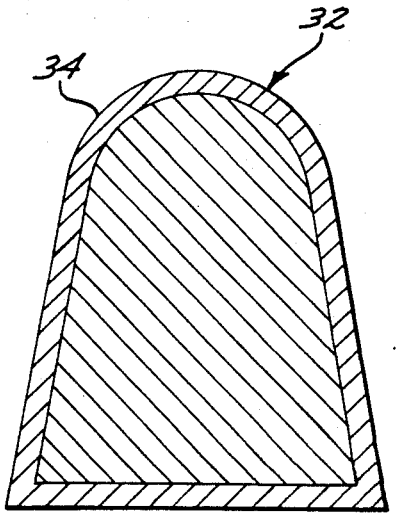
FIG. 4 is a schematic cross-sectional view of a coated cutter insert which is to be incorporated into the cutter cone of the present invention.
Figure 5:
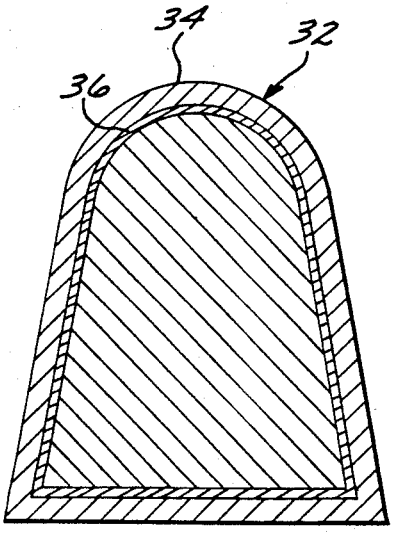
FIG. 5 is a schematic cross-sectional view of another embodiment of a coated cutter insert which is to be incorporated into the cutter cone of the present invention.

Typically, cutter inserts 32 employed in the present invention are of a substantially cylindrical configuration, as is shown on FIGS. 1 and 2, or of a tapered, conical configuration, as shown on FIGS. 3, 4, and 5. The inserts 32 are typically and approximately 1.0" tall, and have a base diameter of approximately ½".

FIG. 4 shows the layer or coating 34 of metal which is disposed on the cutter insert 32 in accordance with the present invention. The metal of the coating 34 is preferably nickel or a suitable nickel alloy. However, as it was noted above, the principal requirement with regard to the coating 34 is that it does not melt completely or significantly while the cast steel cone 22 is poured by conventional casting techniques. What is meant in this regard is that the melting temperature of the metal of the coating 34 may be higher than the temperature of the molten steel poured in the casting step or the coating will be of sufficient thickness such that it does not fully melt under the implicit casting conditions. However, as it will be readily understood by those skilled in the art, a portion of the metal layer or coating 34 may nevertheless melt under these circumstances, due to lowering of the melting temperature at the interface of the metal coating 34 and the molten steel.

Metals or alloys other than nickel or nickel alloys, which, although less preferred, are nevertheless suitable for the coating 34 include titanium, titanium alloys, irridium, irridium alloys, tungsten, tungsten alloys, rhodium, rhodium alloys, osmium, osmium alloys, niobium, niobium alloys, molybdenum, molybdenum alloys, chromium, and chromium alloys.

The coating 34 can be deposited on the cermet cutter inserts 32 by several techniques, which include electroplating, chemical vapor deposition, sputtering, spray coating followed by fusion, and electroless plating. Principal requirements in this regard are that the coating 34 should be non-porous and of relatively uniform thickness. Electroplating is the preferred technique for depositing the coating 34 on the cutter inserts 32. It will be readily recognized by those skilled in the art in this regard, that due to conventional equipment and process limitations, not all of the above-noted metals or metal alloys can be applied to the inserts by each of the above-noted coating or plating processes.

One function of the coating or layer 34 of high melting metal or metal alloy on the cutter insert 32 is to avoid or minimize thermal shock in the cermet cutter insert 32 when the cast steel cutter cone 22 is poured.

Another function of the coating 34 is to prevent degradation of the material of the cutter insert 32 when the cutter insert 32 is exposed to high temperature during the casting of the steel cone 22. As it was noted in the introductory section of the present application for patent, such degradation usually occurs due to carbon diffusion and "eta" phase formation when the commonly used tungsten carbide cobalt (WC-Co) inserts are exposed to high temperature in a steel environment. Thus, the other function of the coating 34, particularly when used on tungsten carbide cobalt (WC-Co) inserts, is to substantially prevent carbon diffusion and substantially eliminate "eta" phase formation in the cutter insert 32.

Thickness of the coating 34 is selected to serve the foregoing functions and objectives. Therefore, the thickness of the coating 34 is dependent on the pouring or casting temperature of the cast steel cone 22, and the actual melting temperature of the metal or metal alloy which comprises the coating 34.

An electroplated nickel coating 34, of approximately 0.001" to 0.015", preferably of approximately 0.006" to 0.008", on tungsten carbide cobalt (WC-Co) inserts 32 of approximately ½" base diameter and approximately 1.0" height, was found in practice to be well suited to accomplish the above-noted functions and objectives. A further advantage of the nickel coating 34 on the inserts 32 is that the nickel forms a transition layer between the cermet insert 32 and the steel cone 22 in the resulting cast steel cones 22. The nickel coating 34 aids in metallurgically bonding the insert 32 to the cone 22.

Referring now to FIG. 5, a hard cermet insert 32 is shown which has a coating or layer 36 of copper, or copper alloys, disposed beneath the layer 34 of the higher melting metal, such as nickel. A tungsten carbide cobalt insert, having a copper layer 36 beneath a nickel layer 34, such as the one shown on FIG. 5, is particularly advantageous because copper has a very strong tendency to prevent diffusion of carbon and to prevent the formation of undesirable "eta" phase in the insert.

The copper layer 36 may be deposited on the insert 32 by the same techniques as the layer 34 of the higher melting metal or metal alloy. Electroplating is also the preferred procedure for depositing the copper layer 36 on the inserts 32. The copper layer 36 on the insert 32 is usually less thick than the layer 34 of high melting metal or metal alloy. Typical thickness of the copper layer 36 is in the 0.0001" to 0.001" range.

In accordance with the present invention, the coated inserts 32, such as the copper and nickel coated tungsten carbide cobalt (WC-Co) inserts shown on FIG. 5, are placed in a suitable mold (not shown). The steel body of the cutter cone 22 is then cast by conventional casting techniques. Steels employed in this casting step include the steels commonly used for making cast steel rock bit cutter cones, such as steels of AISI 9315, EX 55, AISI 4815, and EX 30 designation. When these steels are used for the rock bit cutter cones, a subsequent carburization step is usually included in the overall process of manufacturing the cutter cone 22. This is described in more detail below.

Alternatively, other steel types, such as AISI 4320, 4330, 4340, and 300M can also be used for the cones. After casting, these latter steel types are surface hardened by techniques other than carburizing, such as austenitizing through induction heating, or by electron or laser beam heating followed by rapid cooling, as is described in U.S. Pat. No. 4,303,137, the specification of which is hereby incorporated by reference.

Preferably, the coated cutter inserts 32 are preheated, usually in an inert gas or slightly reducing atmosphere, to approximately 200° to 600° C. prior to the casting step, in order to further minimize thermal shock to the inserts 32.

FIG. 3 of the drawings shows a cutter cone 38 in accordance with the present invention, after the casting step. As is shown on the drawing figure, the cutter inserts 32 are of a tapered, conical configuration. This configuration of the inserts 32 further assures their secure mounting to the cutter cone 38. As it will be readily appreciated by those skilled in the art, cutter inserts 32 of such conical configuration cannot be mounted into preformed holes of cutter cones by mere interference or friction fit.

The cutter cone 38 shown on FIG. 3 will be readily recognized by those skilled in the art as an intermediate, which still must be subjected to machining and other operations, to form the final cutter cone 22 to be mounted on the rock bit journal 24. One such step commonly employed for making the final cutter cone 32 is carburizing the exterior of the cone 32. In accordance with some manufacturing procedures, certain interior bearing surfaces of the cone 32 may also be carburized During such carburization steps, the combined copper and nickel coatings 34 and 36 on the inserts 32 also serve as substitutes for "stop off" paint, and eliminate the requirement for the extra step of applying "stop off" paint on the individual inserts 32.

The copper and nickel coatings 36 and 34 are, of course, readily removed from the exposed portions of the inserts 32 during initial stages of subterranean operation of the rock bit 20.

Tests indicate that substantially larger pulling forces are required to remove the inserts 32 from the cutter cone 22 of the present invention than from prior art cutter cones where the inserts 32 are held merely by interference fit and friction forces.

Several modifications of the novel "hard" cermet insert containing cast steel tools and particularly of the rock bit cutter cones, may become readily apparent to those skilled in the art in light of the above disclosure. Therefore, the scope of the present invention should be interpreted solely from the following claims.

What is claimed is:

1. A process for making a tool having at least one hard cermet cutter insert formed of a metal carbide partially embedded and held in a cast steel core, the process comprising the steps of:

depositing a first coating of a metal selected from a group consisting of copper and copper alloys on the cutter insert;

depositing a second coating of metal on top of said first coating of metal, said second coating of metal being selected such that it protects the first coating of metal from heat degradation;

disposing the cutter insert having the first and second coatings in a suitable mold in operative position for casting the steel core; and casting the steel core from molten steel into the mold thereby partially embedding the cutter insert in the steel core, the metal of the second coating being selected such that the coating does not substantially melt during the step of casting.

2. The process of claim 1 wherein the metal carbide cutter insert is selected from a group consisting of tungsten carbide in a cobalt binder, tungsten carbide in an iron binder, tungsten carbide in an iron-nickel binder, tungsten carbide in an iron-nickel-cobalt binder, non-stoichiometric tungsten molybdenum carbide in a cobalt binder, non-stochiometric tungsten molybdenum carbide in an iron-nickel binder, and non-stochiometric tungsten molybdenum carbide in an iron-nickel-cobalt binder.

3. The process of claim 1 wherein the metal of the second protective coating is selected from a group consisting of nickel, nickel alloys, titanium, titanium alloys, irridium, irridium alloys, tungsten, tungsten alloys, rhodium, rhodium alloys, osmium, osmium alloys, niobium, niobium alloys, molybdenum, molybdenum alloys, chromium, and chromium alloys.

4. The process of claim 1 wherein the step of depositing comprises electroplating.

5. The process of claim 1 wherein the steps of depositing a first and second metal applies a coating of metal approximately 0.001 to 0.015 inch thick on the cutter insert.

6. The process of claim 1 wherein the steps of depositing the first layer of copper and of deposition the second protective layer of metal both comprise electroplating.

7. A process for making a rock bit cutter cone having metallurgically bonded hard cermet inserts formed of a material selected from a group consisting of tungsten carbide in a cobalt binder, tungsten carbide in an iron binder, tungsten carbide in an iron-nickel binder, tungsten carbide in an iron-nickel-cobalt binder, non-stochiometric tungsten molybdenum carbide in a cobalt binder, non-stochiometric tungsten molybdenum carbide in an iron-nickel binder, and non-stochiometric tungsten molybdenum carbide in an iron-nickel-cobalt binder, the cutter inserts being partially embedded and held in a cast steel core, the process comprising the steps of:

depositing a first coating of a metal selected from a group consisting of copper and copper alloys on the cutter insert;

depositing a second coating of a metal on top of said first coating of metal, said second coating of metal being selected such that it protects the first coating of metal from heat degradation and does not substantially melt at the temperature of a subsequent step of casting and that it metallurgically bonds the cutter inserts to the steel core;

disposing the cutter inserts having the first and second metal coatings in a suitable mold in operative position for casting the steel core; and casting the steel core from molten steel into the mold thereby partially embedding the cutter inserts in the steel core.

8. The process of claim 7 wherein the metal of the second protective coating is selected from a group consisting of nickel and nickel alloys.

9. The process of claim 8 wherein in the steps of depositing a first and second metal, a coating of approximately 0.001 to 0.015 inch thick is deposited on the cutter insert.

10. The process of claim 8 wherein the steps of depositing comprises electroplating.

11. The process of claim 7 further comprising the step of hardening at least a portion of the outer surface of the cutter cone after the step of casting.

12. The process of claim 11 wherein said step of hardening comprises rapidly heating the surface followed by rapid cooling.

13. The process of claim 12 wherein the step of rapidly heating comprises induction heating.

14. The process of claim 12 wherein the step of rapidly heating comprises heating through bombardment with an electron beam.

15. The process of claim 12 wherein the step of rapidly heating comprises bombardment with a laser beam.

16. The process of claim 7 wherein the step of depositing comprises electroless plating.

* * * * *